US006011232A

United States Patent [19]

Matthias

[11] Patent Number: 6,011,232

[45] Date of Patent: Jan. 4, 2000

[54] MANUFACTURE OF ELEMENTS FACED WITH SUPERHARD MATERIAL

[75] Inventor: Terry R. Matthias, Longlevens, United Kingdom

[73] Assignee: Camco International (UK) Limited, Stonehouse, United Kingdom

[21] Appl. No.: 09/008,051

[22] Filed: Jan. 16, 1998

[30] Foreign Application Priority Data

Jul. 26, 1999 [GB] United Kingdom ..... 9715771

[51] Int. Cl.[7] ..... E21B 10/46

[52] U.S. Cl. ..... 219/69.17; 219/69.11; 219/68; 175/425; 175/426; 175/428; 175/430

[58] Field of Search ..... 219/69.17, 69.11, 219/68; 175/425, 426, 428, 430

[56] References Cited

U.S. PATENT DOCUMENTS

| | | | |
|---|---|---|---|
| 5,351,772 | 10/1994 | Smith | 175/428 |
| 5,435,403 | 7/1995 | Tibbitts | 175/432 |
| 5,460,233 | 10/1995 | Meany et al. | 175/428 |
| 5,590,729 | 1/1997 | Cooley et al. | 175/432 |
| 5,611,649 | 3/1997 | Mattias et al. | 407/118 |
| 5,617,928 | 4/1997 | Mattias et al. | 175/432 |

FOREIGN PATENT DOCUMENTS

| | | |
|---|---|---|
| 2305449 | 4/1997 | United Kingdom . |
| 2301843 | 6/1997 | United Kingdom . |

*Primary Examiner*—Patrick Ryan
*Assistant Examiner*—M. Alexander Elve
*Attorney, Agent, or Firm*—Jeffery E. Daly

[57] ABSTRACT

A method of manufacturing preform elements comprises the initial step of forming a preliminary component including a facing table of superhard material having a front face, a peripheral surface, and a rear surface bonded to a less hard substrate. The rear surface of the facing table and the front surface of the substrate are formed with inter-engaging projections and recesses to provide a non-planar interface between the substrate and facing table. There are then cut from the preliminary component a plurality of separate preform elements each having a facing table and substrate with a non-planar interface between them. The configuration of the non-planar interface of the preliminary component may vary with distance from its center, so that the non-planar interface of each preform element also varies in configuration across the width of the element.

26 Claims, 5 Drawing Sheets

FIG 6
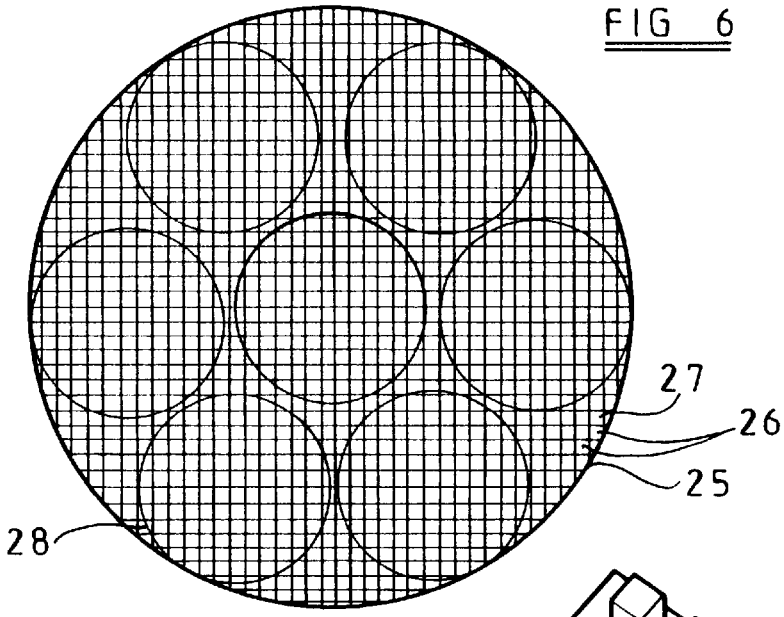
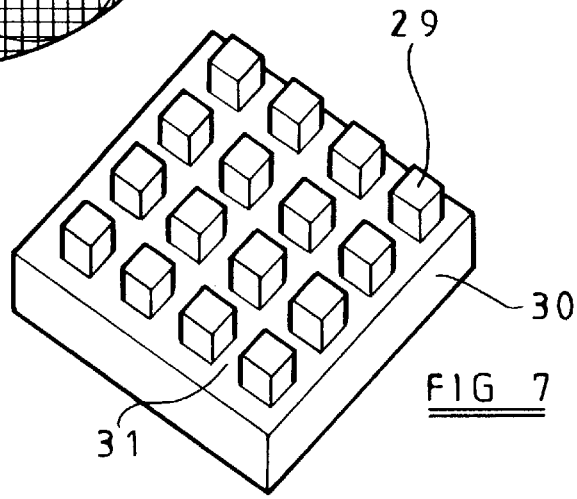
FIG 7
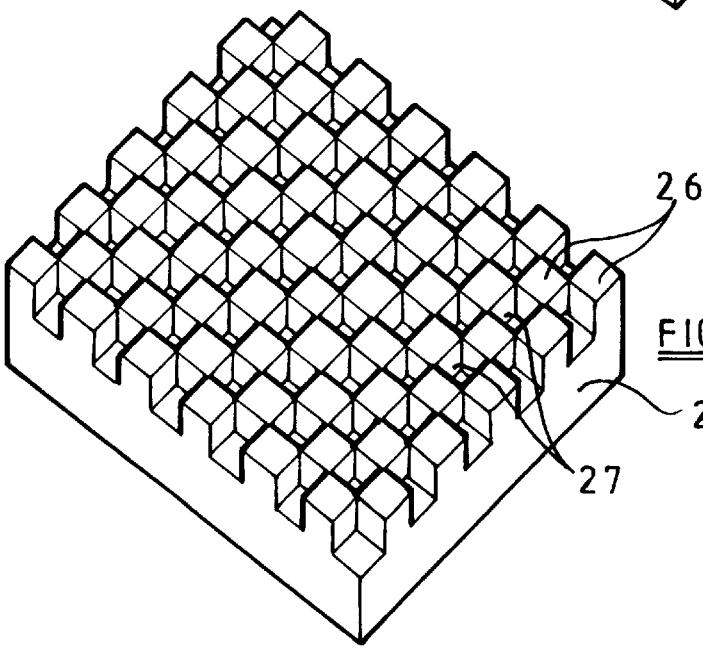
FIG 8

FIG 12
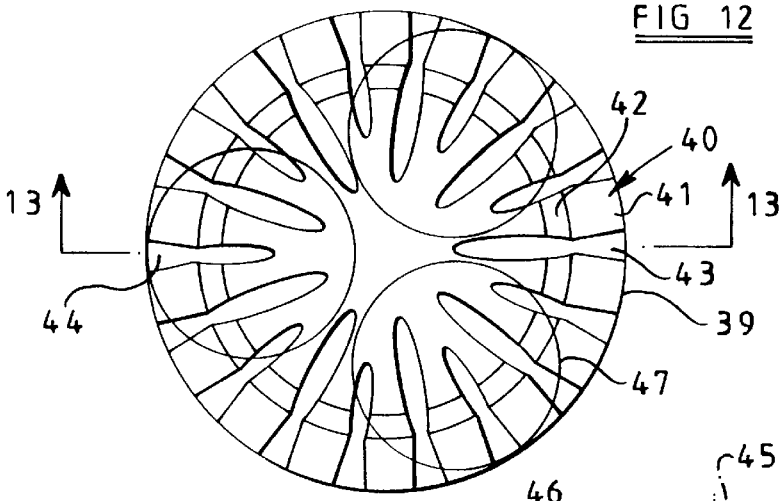
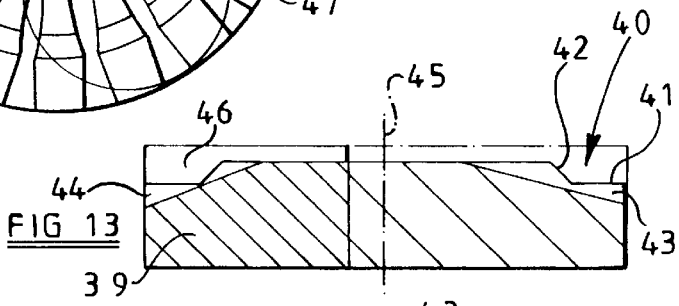
FIG 13
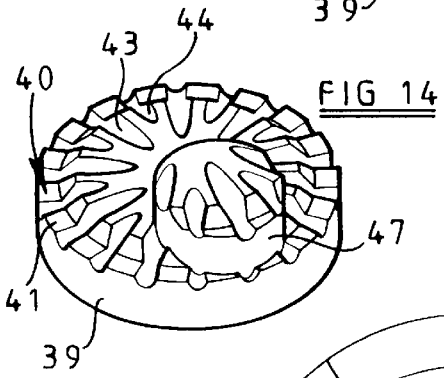
FIG 14
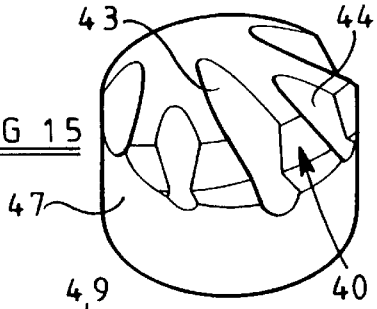
FIG 15
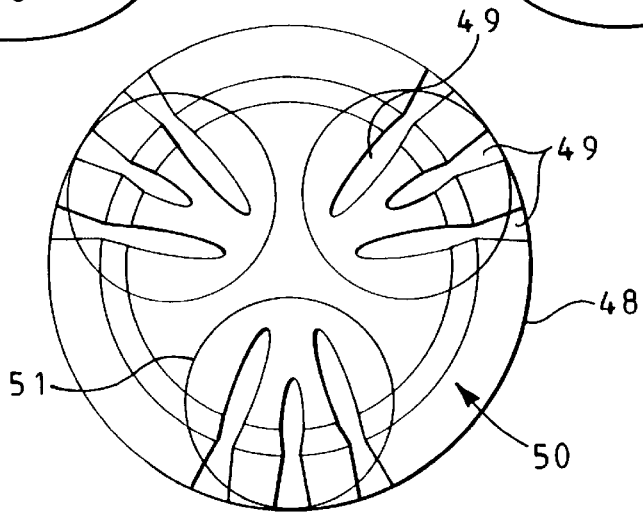
FIG 16

FIG 17
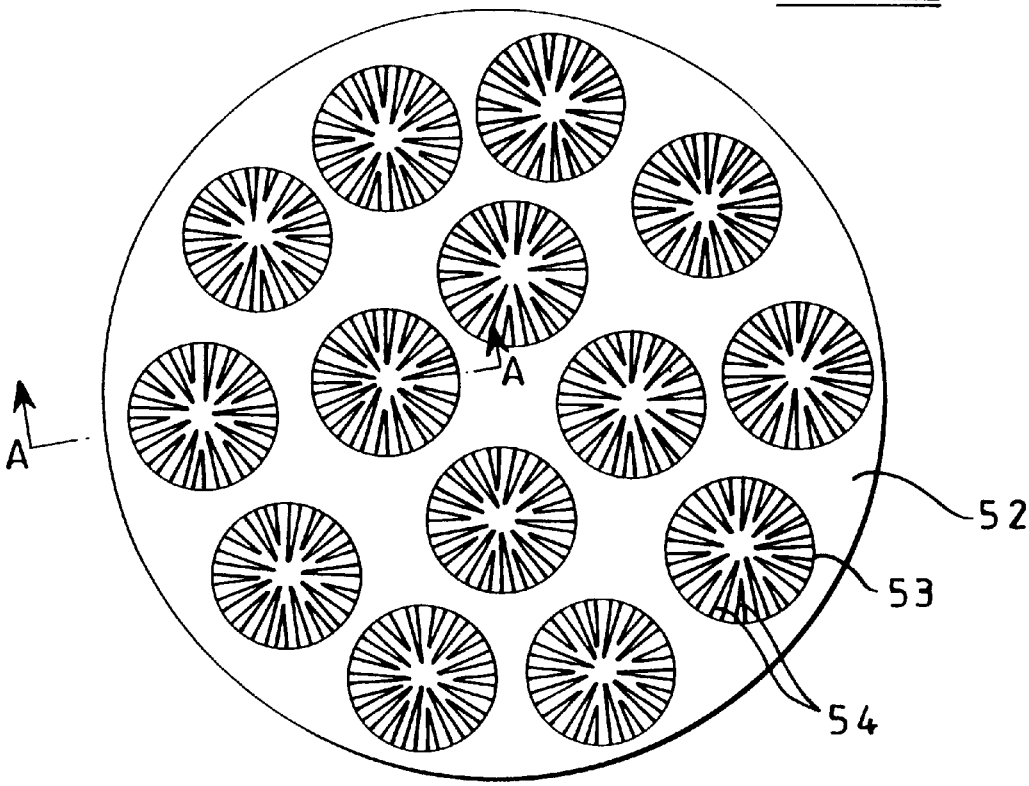
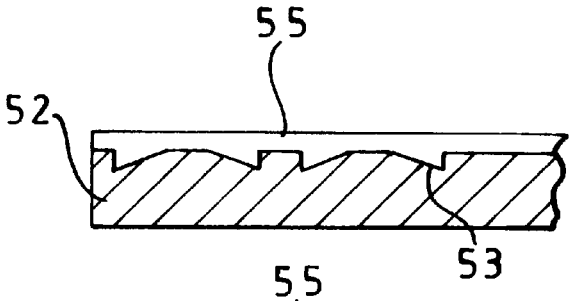
FIG 18
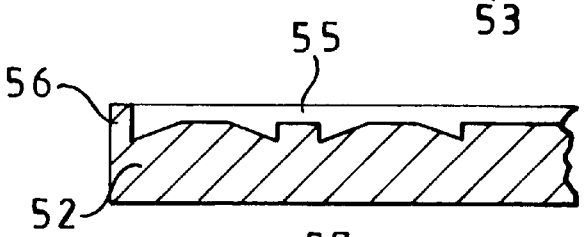
FIG 19
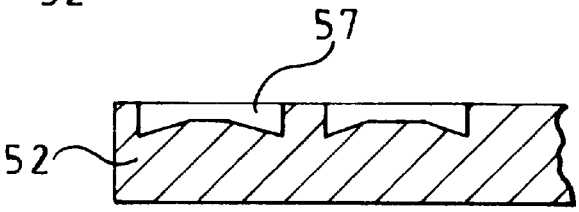
FIG 20

MANUFACTURE OF ELEMENTS FACED WITH SUPERHARD MATERIAL

BACKGROUND OF THE INVENTION

1. Field of the Invention

The invention relates to the manufacture of elements faced with superhard material, and particularly to preform elements comprising a facing table of superhard material having a front face, a peripheral surface, and a rear surface bonded to a substrate of material which is less hard than the superhard material.

2. Description of Related Art

Preform elements of superhard material are often used as cutting elements on rotary drag-type drill bits, and the present invention will be particularly described in relation to such use. However, the invention is not restricted to cutting elements for this particular use, and may relate to preform elements for other purposes. For example, elements faced with superhard material, of the kind referred to, may also be employed in workpiece-shaping tools, high pressure nozzles, wire-drawing dies, bearings and other parts subject to sliding wear, as well as elements subject to percussive loads as may be the case in tappets, cams, cam-followers, and similar devices in which a surface of high wear resistance is required.

Preform elements used as cutting elements in rotary drill bits usually have a facing table of polycrystalline diamond, although other superhard materials are available, such as cubic boron nitride. The substrate of less hard material is often formed from cemented tungsten carbide, and the facing table and substrate are bonded together during formation of the element in a high pressure, high temperature forming press. This forming process is well known and will not be described in detail.

Each preform cutting element may be mounted on a carrier in the form of a generally cylindrical stud or post received in a socket in the body of the drill bit. The carrier is often formed from cemented tungsten carbide, the surface of the substrate being brazed to a surface on the carrier. Alternatively, the substrate itself may be of sufficient thickness as to provide, in effect, a cylindrical stud which is sufficiently long to be directly received in a socket in the bit body, without being brazed to a carrier. The bit body itself may be machined from metal, usually steel, or may be molded using a powder metallurgy process.

Such cutting elements are subjected to extremes of temperature during formation and mounting on the bit body, and are also subjected to high temperatures and heavy loads when the drill is in use down a borehole. It is found that as a result of such conditions spalling and delamination of the superhard facing table can occur, that is to say the separation and loss of the diamond or other superhard material over the cutting surface of the table. This may also occur in preform elements used for other purposes, and particularly where the elements are subjected to repetitive percussive loads, as in tappets and cam mechanisms.

In view of this, particularly in cutting elements for drill bits, attempts have been made to improve the bond between the superhard facing table and the substrate by configuring the interface between the rear surface of the facing table and the front surface of the substrate so that these have inter-engaging projections and recesses to provide a non-planar interface. This may then provide a degree of mechanical interlocking between the facing table and substrate.

In cutting elements for drill bits, one part of the periphery of the element normally provides the cutting edge which is particularly subject to wear and impact loads in use. In some designs of cutting element, therefore, the configuration of the interface between the substrate and facing table has been made asymmetrical so as to increase the thickness and strength of the facing table in the region of the cutting edge and thereby increase the resistance of the cutting element to wear and impact.

Commonly, preform elements having a configured interface between the facing table and substrate have been manufactured individually. The usual method of manufacture has been to provide a solid substrate of the shape and size required for a single preform element and having a front face which is pre-formed with projections and recesses of the required shape. A layer of particulate diamond material is then applied to the front face of the substrate so that the diamond particles fill the recesses in the substrate and form a layer of the required thickness on the front surface of the substrate. The substrate with the applied diamond layer is then placed in the high pressure, high temperature press where the diamond particles are bonded together, with diamond-to-diamond bonding, to form the superhard layer, which in turn is bonded to the configured surface of the substrate.

It is found however that problems can arise with this manufacturing process where there is a non-planar interface between the superhard facing table and the substrate. For example, there may be difficulty in ensuring that all of the recesses on the front surface of the substrate are completely filled and packed with the diamond particles before the assembly is placed in the press. This is particularly the case with asymmetrical configurations of the interface. Also, the cost of manufacture of such preform elements is largely dictated by the number of handling steps involved in the manufacture and the size of the element has only a comparatively minor effect on the cost of manufacture, so that small preforms are relatively costly to manufacture.

The present invention sets out to provide an improved method of manufacturing preform elements where these disadvantages may be overcome.

SUMMARY OF THE INVENTION

According to the invention there is provided a method of manufacturing preform elements comprising the steps of forming a preliminary component including a facing table of superhard material having a front face, a peripheral surface, and a rear surface bonded to a front surface of a substrate which is less hard than the superhard material, the rear surface of the facing table and front surface of the substrate having inter-engaging projections and recesses to provide a non-planar interface between the substrate and facing table, and then cutting from said preliminary component a plurality of separate preform elements each having a facing table and substrate with a non-planar interface between them.

The preform elements may be cut from the preliminary component by electron discharge machining (EDM) or any other suitable method.

The non-planar interface between the facing table and substrate of the preliminary component may extend over substantially the whole area of the inter-engaging surfaces of the facing table and substrate.

Alternatively, the non-planar interface may comprise a plurality of separate non-planar regions spaced apart across the area of the inter-engaging surfaces of the facing table and substrate, each preform element being cut from one of said non-planar regions.

Each preform element may be smaller than the non-planar region from which it is cut, so as to include only a part of the non-planar interface in that region. Alternatively, each region may correspond in peripheral shape to the required shape of a preform element, each preform element then being formed by cutting from the preliminary components substantially the whole of one of said regions.

In the case where the non-planar interface of the preliminary component extends over substantially the whole area of the inter-engaging surfaces of the facing table and substrate, said non-planar interface may be substantially uniform across said surfaces so that the non-planar interfaces of the preform elements cut from any part of the preliminary component are substantially similar.

For example, the non-planar interface may comprise inter-engaging parallel grooves and recesses in the surfaces of the facing table substrate, or parallel rows of similar projections on one surface engaging in parallel rows of corresponding recesses in the other surface.

In the case where the non-planar interface of the preliminary component comprises a plurality of separate non-planar regions, said regions may be substantially symmetrically and/or regularly spaced on the preliminary component, but each non-planar region is not necessarily itself symmetrical and/or regular.

For example, the configuration of said non-planar interface of the preliminary component may be substantially symmetrical about a central transverse axis of the component, but may vary with distance from said axis, said preform elements being cut from regions of the preliminary component which are substantially the same distance from said axis. As a result the preform elements will be substantially similar to one another, but a part of each element which was nearer the axis of the preliminary component will differ in configuration from a part of the element which was nearer said axis.

In a preferred embodiment the preliminary component is substantially circular. Each preform element cut from the preliminary component may also be circular.

In this case the inter-engaging surfaces of the facing table and substrate of the preliminary component may have inter-engaging formations, such as ribs and grooves, which extend inwardly away from the peripheral surface of the preliminary component towards the central transverse axis thereof. Said formations may then be symmetrical with respect to the preliminary component but may be asymmetrically arranged with respect to each preform element which is cut from a region of the preliminary component between said peripheral surface and axis.

Said formations may extend generally radially with respect to the central transverse axis of the preliminary component, or at angles to radii of the preliminary component. Said formations may be of different lengths.

The inter-engaging formations may include one or more formations which extend circumferentially of the preliminary component. For example, there may be provided at least one circumferential rib on one surface which engages in a corresponding circumferential groove in the other surface. Preferably the rib is formed around or adjacent the periphery of the rear surface of the facing table of the preliminary component, and each preform element is cut from a region of the preliminary component where the rib passes across part of the periphery of the preform element. Such arrangement provides that the facing table will have greater thickness around one region of the periphery of the preform element, and the thickened region may thus form the cutting edge of a preform cutting element for drill bits.

In any of the above arrangements there may be provided a transition layer between the superhard material and the less hard material. As is well known, such transition layers normally comprise material having one or more properties, such as coefficient of thermal expansion and/or elastic modules, which is intermediate the corresponding properties of the superhard and less hard materials.

The transition layer may, for the purposes of the present invention, be regarded either as a part of the facing table or as a part of the substrate of the preliminary component or resulting preform elements. Thus, the non-planar interface referred to above may be provided between the superhard material and the transition layer, or between the transition layer and the less hard material, or at both said interfaces. The invention includes within its scope arrangements where one said interfaces is configured and non-planar, while the other interface may be planar or configured, so as to be non-planar, in a different manner.

Any of the facing table, the substrate, and the transition layer may comprise a plurality of different layers or portions bonded together and do not necessarily comprise a unitary body of material.

Preferably the preliminary component is formed by providing a solid substrate having a configured non-planar front face formed with projections and recesses, applying to the front face of the substrate a layer of particulate superhard material so that the particles fill the recesses in the substrate, and then subjecting the substrate and particulate superhard layer to high temperature and pressure in a press so as to bond the superhard particles together and to the substrate.

BRIEF DESCRIPTION OF THE DRAWINGS

The following is a more detailed description of embodiments of the invention, by way of example, reference being made to the accompanying drawings in which:

FIG. 6 is a similar view to FIG. 1 of the substrate of an alternative form of component.

FIGS. 7 and 8 are diagrammatic perspective views of portions of two alternative forms of substrate for use in the component of FIG. 6.

FIGS. 9–12 are similar views to FIGS. 1 and 6 showing alternative forms of non-planar interface.

FIG. 13 is a section on the line 13—13 of FIG. 12.

FIG. 14 is a perspective view of the arrangement shown in FIGS. 12 and 13 showing the substrate of one preform element being removed from the preliminary component.

FIG. 15 is an enlarged view of the substrate of a preform element

FIG. 16 is a similar view to FIG. 12 of an alternative arrangement.

FIG. 17 is a view of a still further arrangement.

FIGS. 18–20 are diagrammatic sections through alternative versions of the arrangement shown in FIG. 17.

DETAILED DESCRIPTION OF THE PREFERRED EMBODIMENTS

FIGS. 1, 6, 9–12 and 14–17 show only the substrate of the preliminary component, so that the configuration of the front surface of the substrate can be seen, but these figures also show the locations where preform elements will be cut from the complete preliminary component, after the layer of superhard material has been added.

Figure 1:
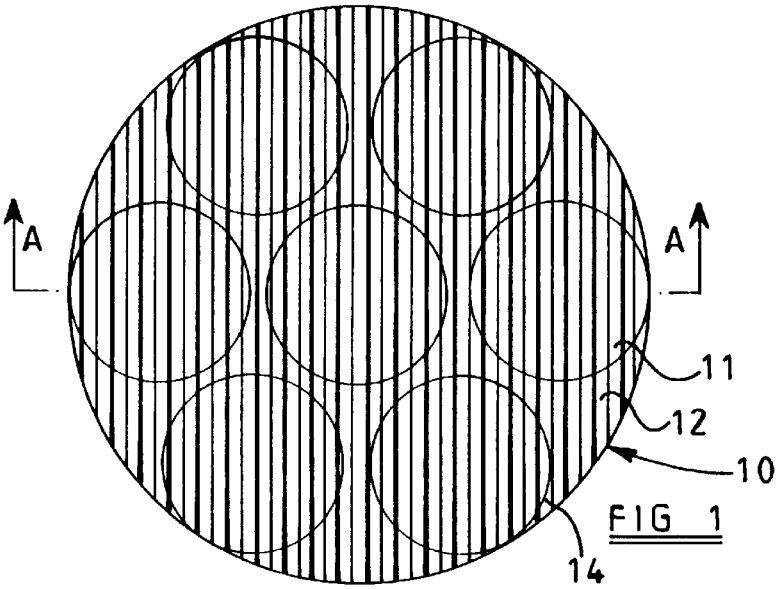
FIG. 1 is a diagrammatic representation of the substrate of a preliminary component for use in a method according to the present invention.

The substrate of one form of preliminary component for use in the method according to the present invention is shown in FIG. 1. The substrate 10 is formed from cemented tungsten carbide and is in the form of a circular tablet, the upper surface of which is formed with alternating parallel ribs 11 and grooves 12.

Figure 2:
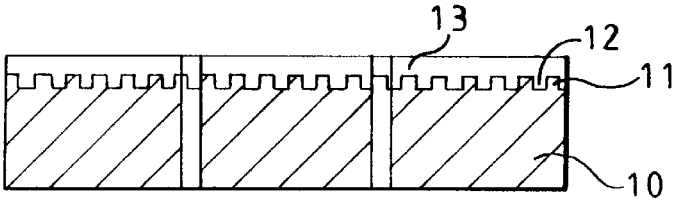
FIGS. 2–5 are diagrammatic sections through various preliminary components including a substrate of the general kind shown in FIG. 1, showing different configurations for the non-planar interface.

As best seen in FIG. 2, in the finished preliminary component there is applied to the front configured surface of the substrate 10 a front facing table 13 of polycrystalline diamond or other superhard material, the front facing table being formed with parallel alternating ribs and grooves which inter-engage with the ribs 11 and grooves 12 on the substrate 10.

The preliminary component is manufactured using the same method as is commonly used for manufacturing individual preform elements. That is to say the substrate 10 is preformed with the ribs and grooves on its front surface. The substrate may be preformed by a molding process or may be machined from solid material.

A layer of diamond or other superhard particles is then applied to the front surface of the substrate 10 so that the particles fill the grooves 12 between the ribs 11 and form a layer above the ribs 11. The assembly is then placed in a high pressure, high temperature press and is subjected to very high temperatures and pressures so that the diamond particles bond to one another and to the material of the substrate so as to form the solid superhard layer 15.

When the preliminary component is removed from the press, a number of preform elements 14 are cut from the preliminary component, for example seven components at the positions indicated in FIG. 1, so as to produce a number of generally similar preform elements each having between its substrate and front facing table a configured interface of the kind shown in FIG. 2.

Figure 3:
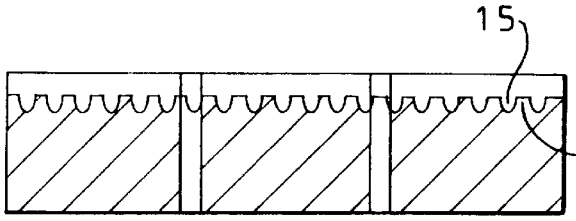
Figure 4:
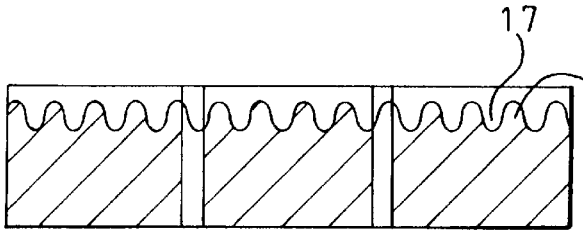
Figure 5A:
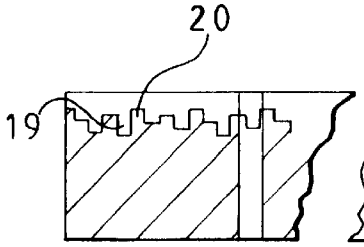
Figure 5B:
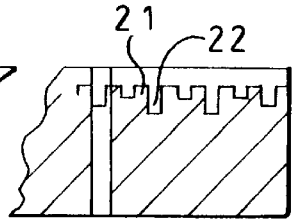
Figure 5C:
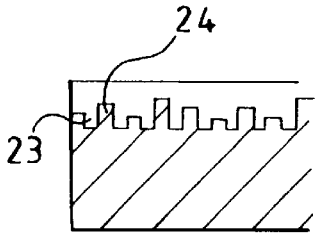

FIGS. 3–5 show alternative configurations for the non-planar interface between the substrate and facing table. In FIG. 3 the grooves 15 between the ribs 16 have rounded bottoms. In the arrangement of FIG. 4 both the bottoms of the grooves 17 and the tops of the ribs 18 on the substrate are rounded so that the interface is, in section, generally sinusoidal in shape.

In the arrangements of FIGS. 24 the ribs and grooves are of constant depth, and FIG. 5 shows three alternative arrangements where the ribs and grooves are of varying depth. In FIG. 5(*a*) both the depths of the grooves 19 and the height of the ribs 20 varies irregularly across the width of the preliminary component and of each resulting preform element In the arrangement of FIG. 5(*b*) the tops of the ribs 21 all lie at the same level, but the depths of the grooves 22 between them vary irregularly across the component. In FIG. 5(*c*) the bottoms of the grooves 23 in the substrate lie on the same level while the height of the ribs 24 varies irregularly across the width of the component.

FIG. 6 shows an arrangement where the configured front surface of the substrate 25 comprises rectangular projections 26 arranged in parallel rows over the front surface of the substrate 10 and separated by rectangular recesses 27. A portion of the substrate 25 is shown in diagrammatic perspective view in FIG. 8.

As in the previous arrangement the substrate 25 is preformed and a layer of particles of diamond or other superhard material is applied to its front surface so as to fill the recesses 27 and form a front facing table for the complete preliminary component. As in the previous arrangement seven preform elements 28 (or any other number, depending on their size) may be cut from the single preliminary component by electron discharge machining or other means.

FIG. 7 shows diagrammatically an alternative arrangement where the upward projections 29 on the substrate 30 are spaced from one another regularly across the substrate so that the recesses 31 between the projections 29 are interconnected.

As previously described, the method according to the invention is particularly suitable for the convenient manufacture of preform elements where the configured non-planar interface between the substrate and facing table of the element is non-symmetrical. When such elements are manufactured individually, it may be difficult to ensure that the recesses in the substrate of the preform element are completely filled and firmly packed with the superhard particles. Such packing is normally effected by pounding or vibrating a tamping device on the top of the layer of particles, but such arrangement works best if the grooves in the substrate are symmetrically arranged since then all parts of the assembly are subjected to the same tamping effect.

The present invention may overcome this problem by providing a generally symmetrical preliminary component in which the particles may more effectively be tamped into the recesses in the substrate, the non-symmetrical shape of the interface on the resulting preform elements being determined by the manner in which the preform elements are cut from the symmetrical preliminary component.

Figure 9:
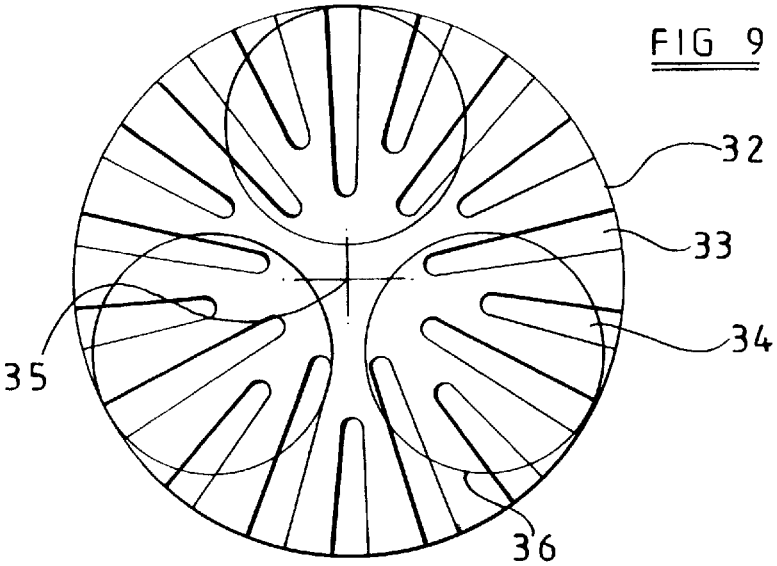
Figure 10:
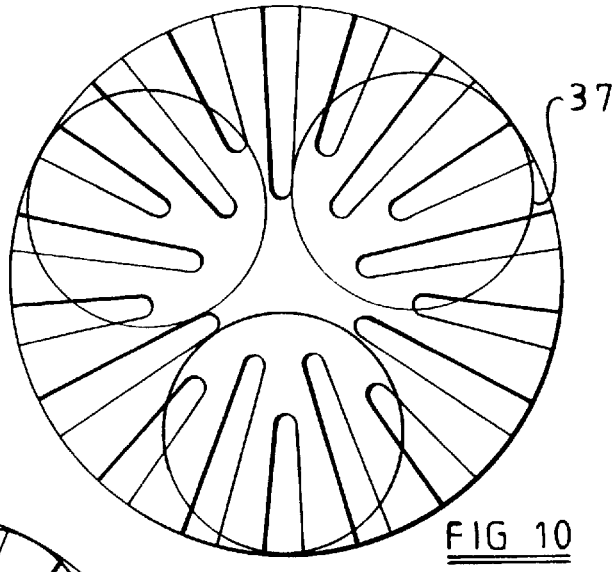
Figure 11:
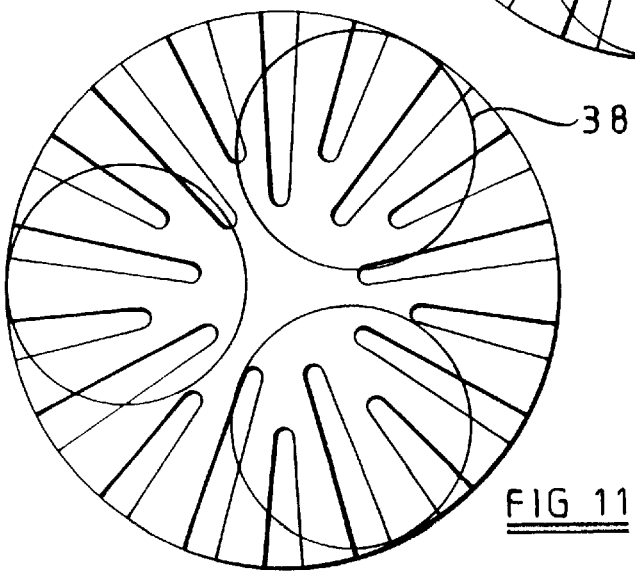

FIGS. 9–11 show such arrangements. Referring to FIG. 9, the circular substrate 32 of the preliminary component is formed in its upper surface with a plurality of long grooves 33 and shorter grooves 34 which extend generally radially inwards from the periphery of the substrate towards the central transverse axis 35 of the substrate. Each groove 33, 34 tapers inwardly as it extends towards the axis and each groove may be of maximum depth at the periphery of the substrate 32, gradually decreasing in depth as it extends towards the axis 35.

As a result of this configuration the superhard facing table which is applied to this substrate is effectively formed with downwardly projecting ribs of superhard material which extend into the grooves 33, 34 in the substrate.

Three circular preform elements 36 may be cut from the completed preliminary component as shown in FIG. 9. Each preform element 36 is cut from a region of the preliminary component between the central axis 35 of the component and its outer periphery with the result that the grooves 33, 34 in the substrate of the preform element, and the corresponding ribs on the underside of the superhard facing table, are asymmetrically arranged with respect to the preform element itself. That is to say, the deepest parts of the ribs on the underside of the facing table are disposed around a portion of the periphery of the preform element which was closer to the periphery of the preliminary component, and this portion of the preform element may be used as the cutting edge, in the case where element is a cutting element for a drill bit, and since the effective depth of the facing table is greater in regions of this cutting edge the strength of the cutting edge may be improved.

FIGS. 10 and 11 show different ways of cutting preform elements 37 or 38 from the preliminary component of the kind shown in FIG. 9, but so as to give slightly different configurations for the non-planar interface between the substrate and facing table of the preform element.

The substrate 39, shown in FIG. 12, for a preliminary component is somewhat similar to the configuration shown in FIGS. 9–11, but in this case the substrate 39 is formed with a peripheral recess 40 having a flat bottom wall 41 and an inclined inner wall 42. As best seen in FIG. 13, the maximum depth of the radial grooves 43, 44 is greater than the depth of the peripheral groove 40, and the grooves 43, 44 decrease in depth as they extend inwardly towards the central transverse axis 45 of the preliminary component. FIG. 13 also shows the superhard front facing table 46 applied to the substrate 39, the superhard material filling the recess 40 and grooves 43, 44 so as to provide on the facing table 46 a downwardly projecting peripheral wall around which are spaced downwardly projecting radial ribs.

As in the previously described arrangements of FIGS. 9–11, three separate preform elements 47 may be cut from the preliminary component so as to provide elements with a non-symmetrical configured interface between the substrate and facing table of the component.

FIG. 14 is a perspective view of the substrate 39 showing the peripheral groove 40 and the radial grooves 43, 44. FIG. 14 also shows the substrate of a preform element 47 being cut from the substrate 39, although it will be appreciated that, in practice, the preform elements 47 are cut from the completed preliminary component after the facing table has been applied to the substrate 39, so that each preform element cut from the preliminary component is complete with facing table and substrate.

FIG. 15 shows the substrate of one of the preform elements 47 on an enlarged scale. It will be seen that a portion of the peripheral groove 40 of the substrate 39 of the preliminary component extends around a substantial portion of the periphery of the substrate of the preform element 47. This portion of the groove 40 will be filled with superhard material, as will be the grooves 43, 44, thus providing a substantially increased thickness of superhard material in one region of the periphery of the preform element thus increasing substantially the strength of the element in this region, so that it can be effectively used as the cutting edge of the element.

FIG. 16 shows an alternative arrangement where the substrate 48 of the preliminary component is generally similar to the arrangement shown in FIG. 12, but where there are provided three equally spaced regions of the substrate where only three radial grooves 49 are provided in addition to the peripheral groove 50. In this case the preform elements 51 are cut from the regions where the radial grooves 49 are located so as to provide only three diverging non-symmetrical grooves in each preform element.

In the arrangements of FIGS. 1 and 6 similar preform elements (which need not all be of the same size or shape) may be cut from any region of the preliminary component and may be of any size shape or number. In the arrangements of FIGS. 9–16 the preform elements may also be of any desired size or shape, but the nature of the configuration of the non-planar interface in the preform elements will depend on which region of the preliminary components they are cut from, and on the size of the preform element.

FIG. 17 shows an alternative arrangement where the preliminary component has a non-planar interface which is configured to provide specific regions from each of which a preform element must be cut to achieve the required configuration of non-planar interface on each preform element.

Referring to FIG. 17, the substrate 52 of the preliminary component is formed on its front surface with a plurality of circular regions 53 each of which is formed with radial grooves 54 extending inwardly from the periphery of the region towards the center thereof However, the configuration of these regions is by way of example only and the regions might have any of the configuration characteristics described above or as desired according to the required shape and final interface configuration of the preform element.

After the preliminary component has been manufactured by the application of the front facing table of polycrystalline diamond or other superhard material, filling the regions 53, the preform elements are formed by cutting these circular regions from the preliminary component Although it will normally be desirable for each preform element to comprise the whole of one of the regions 53, it will be appreciated that smaller preform elements could be formed by cutting the element from only a portion of each region 53. If the preform element is coaxial with the region 53, then its configured interface will be symmetrical, but if it is offset with respect to the central axis of each region 53, its configured interface will be non-symmetrical.

FIGS. 18–20 show alternative ways in which the regions 53 may be defined.

In the arrangement of FIG. 18 the superhard layer 55 extends across the whole of the front surface of the substrate 52 as well as filling the regions 53.

In the arrangement of FIG. 19 the substrate 52 of the preliminary component is provided with an upstanding peripheral wall 56 which extends around the superhard facing table 55.

In the arrangement of FIG. 20 the superhard facing table comprises separate portions 57 which fill only the regions 53 and the facing table does not otherwise extend across the surface of the substrate 52 between such regions.

As previously described, in any of the above arrangements there may be provided a transition layer between the superhard facing table and substrate of the preliminary component, so as to provide a corresponding transition layer between the facing table and substrate of each individual preform element cut from the preliminary component. As previously mentioned, the configured non-planar interface may be disposed between the facing table and the transition layer, between the transition layer and the substrate, or at both interfaces.

The interface configurations, and the overall shapes of the preform elements, illustrated and described above are by way of example only, and it will be appreciated that the method according to the invention may be applied to provide any form of configured interface in the resulting preform elements, and any shapes or sizes of preform elements.

Whereas the present invention has been described in particular relation to the drawings attached hereto, it should be understood that other and further modifications, apart from those shown or suggested herein, may be made within the scope and spirit of the present invention.

What is claimed:

1. A method of manufacturing preform elements comprising the steps of forming a preliminary component including a facing table of superhard material having a front face, a peripheral surface, and a rear surface bonded to a front surface of a substrate which is less hard than the superhard material, the rear surface of the facing table and front surface of the substrate having a plurality of inter-engaging projections and recesses to provide a non-planar interface between the substrate and facing table, and then cutting from said preliminary component a plurality of separate preform elements each having a facing table and substrate with a non-planar interface between them.

2. A method according to claim 1, wherein the preform elements are cut from the preliminary component by electron discharge machining (EDM).

3. A method according to claim 1, wherein the non-planar interface between the facing table and substrate of the preliminary component extends over substantially the whole area of the inter-engaging surfaces of the facing table and substrate.

4. A method according to claim 3, wherein said non-planar interface is substantially uniform across said surfaces so that the non-planar interfaces of the preform elements cut from any part of the preliminary component are substantially similar.

5. A method according to claim 1, wherein the non-planar interface includes inter-engaging parallel grooves and recesses in the surfaces of the facing table substrate.

6. A method according to claim 1, wherein the non-planar interface includes parallel rows of similar projections on one surface engaging in parallel rows of corresponding recesses in the other surface.

7. A method according to claim 1, wherein the configuration of said non-planar interface of the preliminary component is substantially symmetrical about a central transverse axis of the component.

8. A method according to claim 7, wherein the configuration of said non-planar interface of the preliminary component varies with distance from said axis, said preform elements being cut from regions of the preliminary component which are substantially the same distance from said axis, whereby the preform elements are substantially similar to one another, but a part of each element which was nearer the axis of the preliminary component differs in configuration from a part of the element which was further from said axis.

9. A method according to claim 1, wherein the inter-engaging surfaces of the facing table and substrate of the preliminary component have inter-engaging formations which extend inwardly away from the peripheral surface of the preliminary component towards the central transverse axis thereof.

10. A method according to claim 9, wherein said formations are symmetrical with respect to the preliminary component but are asymmetrically arranged with respect to each preform element which is cut from a region of the preliminary component between said peripheral surface and axis.

11. A method according to claim 9, wherein said formations extend generally radially with respect to the central transverse axis of the preliminary component.

12. A method according to claim 9, wherein said formations are of different lengths.

13. A method according to claim 9, wherein the inter-engaging formations include at least one formation which extends circumferentially of the preliminary component.

14. A method according to claim 13, wherein there is provided at least one circumferential rib on one surface which engages in a corresponding circumferential groove in the other surface.

15. A method according to claim 14, wherein said circumferential rib is formed adjacent the periphery of the rear surface of the facing table of the preliminary component, and each preform element is cut from a region of the preliminary component where the rib passes across part of the periphery of the preform element.

16. A method according to claim 1, wherein the non-planar interface comprises a plurality of separate non-planar regions spaced apart across the area of the inter-engaging surfaces of the facing table and substrate, each preform element being cut from one of said non-planar regions.

17. A method according to claim 16, wherein each preform element is smaller than the non-planar region from which it is cut, so as to include only a part of the non-planar interface in that region.

18. A method according to claim 16, wherein each region corresponds in peripheral shape to the required shape of a preform element, each preform element then being formed by cutting from the preliminary components substantially the whole of one of said regions.

19. A method according to claim 16, wherein the separate non-planar regions are substantially regularly spaced on the preliminary component.

20. A method according to claim 1, wherein the preliminary component is substantially circular.

21. A method according to claim 2, wherein each preform element cut from the preliminary component is circular.

22. A method according to claim 1, wherein there is provided a transition layer between the superhard material and the less hard material.

23. A method according to claim 1, wherein the preliminary component is formed by providing a solid substrate having a configured non-planar front face formed with projections and recesses, applying to the front face of the substrate a layer of particulate superhard material so that the particles fill the recesses in the substrate, and then subjecting the substrate and particulate superhard layer to high temperature and pressure in a press so as to bond the superhard particles together and to the substrate.

24. A method of manufacturing preform elements comprising the steps of forming a preliminary component including a facing table of superhard material having a front face, a peripheral surface, and a rear surface bonded to a front surface of a substrate which is less hard than the superhard material, the rear surface of the facing table and front surface of the substrate having a plurality of inter-engaging projections and recesses to provide a non-planar interface between the substrate and facing table, and then cutting from said preliminary component a plurality of separate preform elements each having a facing table and substrate with a non-planar interface between them, the configuration of said non-planar interface of the preliminary component varying with distance from said axis, whereby a part of each preform element which was nearer the axis of the preliminary component differs in configuration from a part of the element which was further from said axis.

25. A method of manufacturing preform elements comprising the steps of forming a preliminary component including a facing table of superhard material having a front face, a peripheral surface, and a rear surface bonded to a front surface of a substrate which is less hard than the superhard material, the rear surface of the facing table and front surface of the substrate having a plurality of inter-engaging projections and recesses to provide a non-planar interface between the substrate and facing table, and then cutting from said preliminary component a plurality of separate preform elements each having a facing table and substrate with a non-planar interface between them, there being provided at least one circumferential rib on one surface which engages in a corresponding circumferential groove in the other surface, each preform element being cut from a region of the preliminary component where the rib passes across part of the periphery of the preform element.

26. A method according to claim 25, wherein the preliminary component and said rib are circular.

* * * * *